United States Patent [19]

Brazelton

[11] Patent Number: 4,981,367

[45] Date of Patent: Jan. 1, 1991

[54] PORTABLE MIXING APPARATUS

[75] Inventor: Carl L. Brazelton, Kankakee, Ill.

[73] Assignee: Stranco, Inc., Bradley, Ill.

[21] Appl. No.: 386,939

[22] Filed: Jul. 28, 1989

[51] Int. Cl.[5] ..... B01F 7/06

[52] U.S. Cl. ..... 366/308; 366/251

[58] Field of Search ..... 366/279, 308, 281, 282, 366/285, 286, 244, 245, 247, 249, 250, 251, 261

[56] References Cited

U.S. PATENT DOCUMENTS

| | | | |
|---|---|---|---|
| 364,059 | 5/1887 | Stauffert . | |
| 1,435,289 | 11/1922 | Gilbert . | |
| 1,447,653 | 3/1923 | Fish . | |
| 1,827,004 | 10/1931 | Gibson . | |
| 1,841,435 | 1/1932 | Gibson | 366/308 |
| 3,132,850 | 5/1964 | Puchalski | 366/308 |
| 3,223,389 | 12/1965 | Simmonds . | |
| 3,559,962 | 2/1971 | Enssle et al. . | |

FOREIGN PATENT DOCUMENTS

| | | | |
|---|---|---|---|
| 1142994 | 4/1957 | France | 366/308 |

*Primary Examiner*—Robert W. Jenkins

*Attorney, Agent, or Firm*—Welsh & Katz, Ltd.

[57] ABSTRACT

Portable mixing apparatus is disclosed which is specially adapted for use in containers such as standard 55 gallon drums and the like which have an opening or "bung" near an edge of the container. A mounting plate is provided which has a threaded end secured in the bung, and a flange secured at a selected angle to the threaded end. A collapsible propeller and mixing shaft pass into the container through the threaded end and a motor operatively connected to the mixing shaft is secured to the mounting plate around the container opening by spaced bolts which pass through and lock into keyhole slots in the mounting plate. The motor, mixing shaft and propeller are secured at an angle so that the propeller is in a selected quadrant near the axis, and preferably also the bottom, of the container. The apparatus can easily be installed and removed without twisting or tangling the power cord.

5 Claims, 2 Drawing Sheets

PORTABLE MIXING APPARATUS

This invention relates to apparatus for mixing liquid in a drum or other container, and more particularly, to portable drum mixing apparatus for stirring emulsions, dispersions or suspensions of solids which are subject to settling.

BACKGROUND OF THE INVENTION

Portable mixing machines are often used to mix liquids in drums and other shipping containers after storage and prior to the transfer or use of the contents, in order to assure a homogeneous mixture. Some mixing machines use a propeller type mixer arranged in a preferred geometrical relationship in a relatively tall, narrow cylindrical tank in order to achieve optimum mixing efficiency. In the preferred geometric relationship, the propeller is placed at a point near the bottom of the tank with the axis of the propeller shaft following a line from about the top circumferential edge of the tank downward at a vertical angle away from the tank wall and at a horizontal angle to a selected side of the center of the tank as viewed from above.

The contents of such drums often contain a high percentage of solids which are subject to settling and/or are viscous in nature, which can require that a motor of substantial horsepower be used to mix the contents. Such a motor equipped with a propeller, shaft, and mounting device can easily weigh in excess of 30 pounds, which can be difficult for the average person to maneuver and install with safety.

Some commercially available portable mixing machines utilize a clamp type mount to secure the mixer to the upper rim of a drum or tank. This will ordinarily allow the propeller to be positioned for best mixing if the mount is adjusted properly. However, such mixers are difficult to install due to weight considerations and the fact that the machine must be held in position with one hand while the operator secures the mounting clamp with his other hand.

Another type of portable mixer utilizes a mount that screws into the threaded opening provided in the top of drums. For metal drums the standard opening is a 2" female National Pipe Threat (NPT). The standard location for this opening is as near as practical to the edge. Mixers of this type are relatively easy to install on a drum as both hands may be used to guide the male thread into the female thread. However, such machines have disadvantages. The propeller cannot be positioned for optimum mixing because the impeller shaft enters the opening on the axis of the threaded opening. Any appreciable deviation from a coaxial arrangement may result in the propeller contacting the side of the drum as the mount is threaded into the opening. Also, the cord must be managed as the motor is rotated during the threading process.

Accordingly, one object of this invention is to provide new and improved mixing apparatus for mixing liquids in a drum or other container which positions a rotating propeller for optimum mixing efficiency.

Another object is to provide new and improved portable drum mixing apparatus which is easily installed in a positive manner.

Yet another object is to provide new and improved portable drum mixing apparatus which can be secured to a drum or the like in a positive manner, without twisting or tangling the power cord.

SUMMARY OF THE INVENTION

In keeping with one aspect of this invention, portable drum mixing apparatus is adapted for standard 55gallon drum containers having a threaded opening or "bung" near an edge of the container. The apparatus includes a motor which rotates a collapsible propeller or other suitable mixing device secured to the end of a mixing shaft. A mounting plate having a threaded portion and a flange is easily secured by engaging the threaded portion in the bung, and the propeller and mixing shaft pass into the container through the bung and an opening in the threaded portion. The mounting flange is attached to the threaded portion at a predetermined angle and the motor is secured to the flange in a positive manner by spaced bolts which pass through and lock into keyhole slots in the flange. The flange secures the motor, shaft and propeller at a selected angle so that the propeller is in a selected quadrant of the container near the axis, and preferably also the bottom, of the container.

BRIEF DESCRIPTION OF THE DRAWINGS

The above-mentioned and other features of the invention, and the manner of obtaining them will become more apparent, and the invention itself will be best understood by reference to the following description of an embodiment of the invention taken in conjunction with the accompanying drawings, in which.

DETAILED DESCRIPTION

Figure 1:
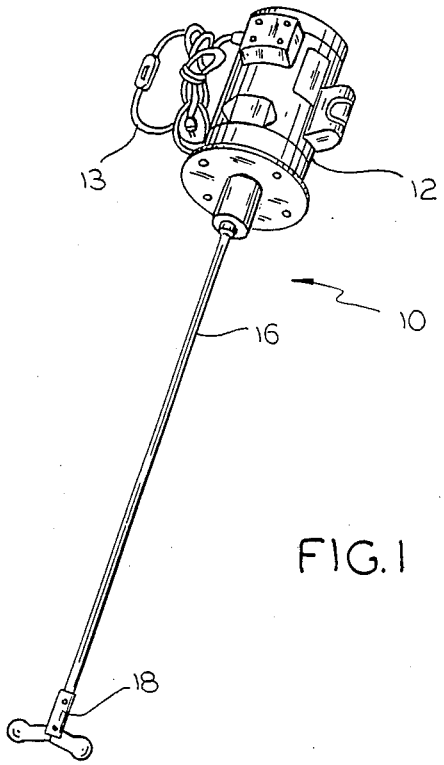
FIG. 1 is an isometric view of an embodiment of the invention.
Figure 6:
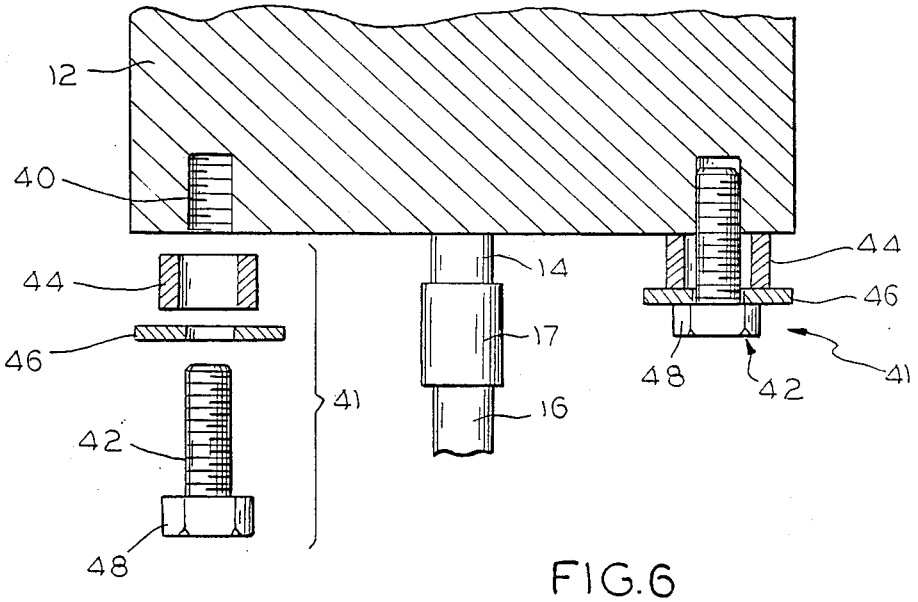
FIG. 6 is a detail view of the mounting hardware secured to the motor in the apparatus of FIG. 1, shown in partial cross-section.

As seen in FIG. 1, portable mixing apparatus 10 includes a motor 12 having a power cord 13 and a shaft 14 (FIG. 6). The motor 12 can be any suitable design, and preferably includes standard bolt holes in the housing, such as those found in a conventional NEMA 56C motor.

The shaft 14 is secured to one end of a mixing shaft 16 by a collar 17 or the like, and a propeller blade mixer 18 (FIG. 1) is secured to the other end of the mixing shaft 16. The propeller 18 is preferably normally collapsed when not rotating, for easy passage through relatively small openings, and opens when rotated at normal speeds such as about 1700–1800 rpm.

Figure 2:
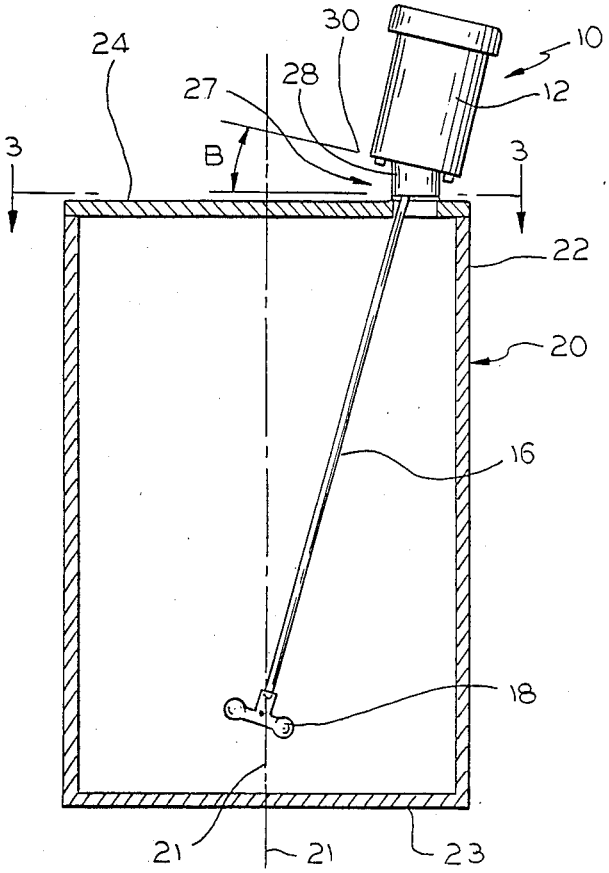
FIG. 2 is an elevational view of the apparatus of FIG. 1 installed in a drum, the drum being shown in cross-section.
Figure 3:
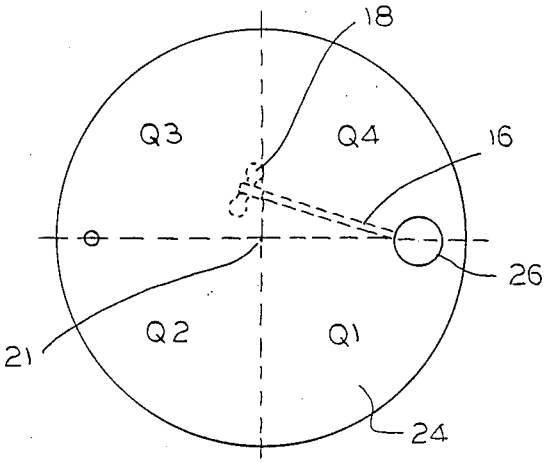
FIG. 3 is a plan view taken along lines 3—3 in FIG. 2.

The apparatus 10 is installed in a standard 55 gallon drum 20 or other container in the manner shown in FIGS. 2 and 3. The drum 20 has an axis 21, and includes a cylindrical outer wall 22, a bottom 23 and a lid 24. The lid 24 has an opening 26 such as a threaded bung near the wall 22.

Figure 5:
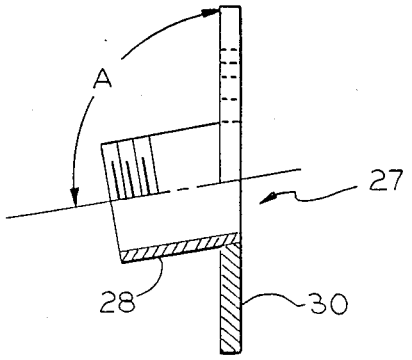
FIG. 5 is a detail view of the mounting plate of FIG. 4, shown in partial cross-section along lines 5—5 in FIG. 4.

The apparatus 10 also includes a mounting plate 27 having a threaded portion 28 and a flange 30 for securing the apparatus to the drum 20. The threaded portion 28 is secured to the flange 30 at an angle A (FIG. 5) by welding or the like. The angle A is selected so that when the apparatus 10 is properly installed in a drum 20, the propeller 18 is located near, but not in contact with, the bottom of the drum 20, and is also near the axis 21 of the drum, away from the wall 22. It is preferable to locate the propeller 18 in quadrant Q3 in FIG. 3, where the bung 26 is on the common line of quadrants Q1 and Q4.

For a standard 55 gallon drum, which is about 35 inches high and about 23 inches in diameter, with the center of the bung located about 3 inches from the edge of the drum, the angle A would preferably be about 98 degrees, which places the plate 30 at about an 8 degree angle to the lid 24, as measured in angle B in FIG. 2.

Figure 4:
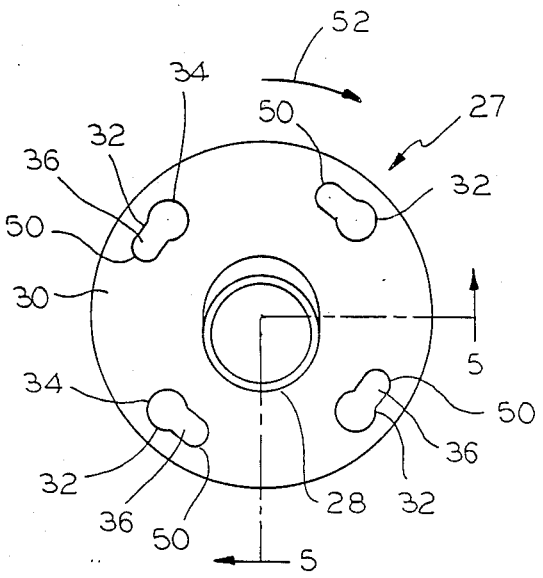
FIG. 4 is a detail view of the mounting plate used in the apparatus of FIG. 1.

The mounting plate 30 includes a plurality of keyhole slots 32 arranged in the circular manner shown in FIG. 4. Each slot 32 includes an enlarged opening 34 and a relatively narrow opening 36 which is contiguous with the opening 34.

The motor 12 includes a plurality of threaded orifices 40 (FIG. 6) which correspond to the keyhole slots 32. A locking extension 41 is secured in each orifice 40. The locking extensions 41 include a bolt 42 which is threadedly secured in each orifice 40, with a spacer 44 and a washer 46. Heads 48 of the bolts 42, and the washers 46, fit through the enlarged openings 34, but not the narrow openings 36. When the bolts 42 are in the narrow openings 36, the motor, mixer shaft and propeller are secured around the opening 26 and are prevented from tilting or moving vertically in an undesired manner, and possibly becoming dislocated, or from rubbing against the opening 26 or the threaded portion 28, without of course inhibiting the rotation of the motor shaft 14.

The keyhole slots 32 are oriented so that the torque created by the rotation of the motor shaft 14 and the shaft 16 presses the spacers 44 against the narrow wall 50 of the narrow openings 36. The direction of rotation of the motor shaft 14 is shown at 52 in FIG. 4. In this manner, the operation of the device maintains the bolts 42 in the narrow openings 36, and further secures the motor 12 to the mounting plate 30 in a positive manner.

Figure 7:
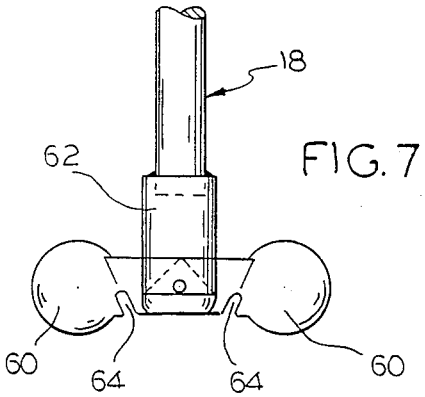
FIG. 7 is a detail view of the collapsible propeller in the apparatus of FIG. 1, shown in the extended position.
Figure 8:
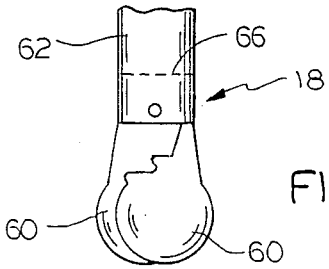
FIG. 8 is another detail view of the collapsible propeller in the apparatus of FIG. 1, shown in the collapsed position.

The propeller 18 is shown in greater detail in FIGS. 7 and 8. The propeller 18 includes a pair of blades 60 which are hingedly secured to a tube 62. The tube 62 is secured in any suitable manner to the end of the shaft 18. The blades 60 may be at an angle to the shaft 18 to better mix the solution in the drum.

When the shaft 18 is not rotating, the blades 60 are collapsed, as in FIG. 8. Notches 64 are provided in the blades 18 so that the blades can collapse more compactly. When the shaft 18 is rotated, centrifugal force extends the blades 18 in the manner shown in FIG. 7, pressing the blades against an internal wall 66 in the tube 62.

The apparatus 10 is assembled by securing the motor 12, shaft 16 and propeller 18 in the manner shown in FIGS. 1 and 6. In use, the threaded portion 28 is threaded in the drum opening 26 so that the flange 30 is oriented properly, as shown in FIGS. 2 and 3. The motor 12 is then secured to the plate 30 by inserting the heads 48 of the bolts 42 and the washers 46 through the enlarged openings 34 of the keyhole slots 32, and turning the motor 12 until the spacers 44 are secured in the narrow openings 36. In this manner, the propeller 18 is secured in quadrant Q3, near the axis and bottom of the drum 20. The apparatus is secured around the bung and shaft so that the shaft does not rub against the bung or the threaded portion during operation. Also, the motor 12 can be easily secured to and removed from the plate 30 without twisting or tangling the power cord 13.

Many variations of the mixing apparatus are contemplated. For example, the spacers 44 and washers 46 could be eliminated, if desired, and other motor mounting hardware, such as a separate plate mounting surface secured to the bottom of the motor, might be provided, if desired. Also, a mixer other than the propeller 18 might be used under appropriate conditions.

The many advantages of this invention are now apparent. The mounting plate places the shaft at a desired angle so that the propeller is in a selected quadrant near the axis of the drum when properly installed. In addition, the motor is easily secured to the plate in a positive manner, and the shaft does not rub against the bung or the mounting plate during operation. Furthermore, the motor can be easily secured to and removed from the mounting plate without twisting or tangling the power cord during installation and removal.

While the principles of the invention have been described above in connection with specific apparatus and applications, it is to be understood that this description is made only by way of example and not as a limitation on the scope of the invention.

What is claimed is:

1. Portable mixing apparatus for a solution in a container having a vertical outer wall, a lid secured to one end of the wall and a bottom secured to the other end of the wall, the lid having a threaded opening near the wall, comprising a motor having a power cord and a motor shaft;

a mixing shaft secured at one end to one end of said motor shaft;

mixing means secured to the other end of said mixing shaft for mixing the solution; and means for securing said motor outside said container with said mixing shaft and said mixing means inside said container, without twisting or tangling said power cord, said securing means securing said motor, propeller and mixing shaft around the lid opening to prevent tilting, rubbing against the lid opening or securing means, or other undesired motion by said motor, mixing shaft and mixing means during operation, without inhibiting the rotation of said motor shaft, mixing shaft and mixing means, said securing means having a mounting plate having a threaded portion for securement to the threaded lid opening, and a flange secured to said mounting plate at a selected angle to the axis of said mounting plate, so that said mixing means can be located away from the wall of the container when said motor is secured to said mounting plate.

2. The apparatus of claim 1 wherein said securing means further comprises a plurality of keyhole slots in said mounting plate, said keyhole slots having an enlarged portion adjacent a narrow portion, and a plurality of locking extensions secured to said motor, said extensions fitting into and locking within said keyhole slots.

3. The apparatus of claim 1 wherein said motor includes a plurality of threaded openings, and each of said locking extensions includes a bolt threaded into one of said openings and a spacer surrounding each of said bolts, said bolts having a head which fits through the enlarged portion of one of said keyhole slots, but not through the adjacent narrow portion, said spacer fitting into said narrow portion of one of said keyhole slots.

4. The apparatus of claim 1 wherein said mixing means comprises a collapsible propeller.

5. The apparatus of claim 1 wherein the container is a 55 gallon drum, and said mixer shaft is secured to the lid of the drum at an angle of about 8 degrees with respect to the lid.

* * * * *